US008439409B2

(12) United States Patent
Uto et al.

(10) Patent No.: US 8,439,409 B2
(45) Date of Patent: May 14, 2013

(54) DOOR UNIT

(75) Inventors: Ryoji Uto, Tokyo (JP); Shigemi Takeuchi, Kobe (JP)

(73) Assignee: Caterpillar SARL, Geneva (CH)

( * ) Notice: Subject to any disclaimer, the term of this patent is extended or adjusted under 35 U.S.C. 154(b) by 465 days.

(21) Appl. No.: 12/374,952

(22) PCT Filed: Jul. 4, 2008

(86) PCT No.: PCT/JP2008/062166

§ 371 (c)(1),
(2), (4) Date: Jan. 23, 2009

(87) PCT Pub. No.: WO2009/057351

PCT Pub. Date: May 7, 2009

(65) Prior Publication Data

US 2010/0223855 A1 Sep. 9, 2010

(30) Foreign Application Priority Data

Oct. 29, 2007 (JP) ..... 2007-280255

(51) Int. Cl.

| | |
|---|---|
| ***E05C 3/06*** | (2006.01) |
| ***E05C 17/44*** | (2006.01) |
| ***E05C 19/00*** | (2006.01) |
| ***E05B 15/02*** | (2006.01) |

(52) U.S. Cl.
USPC ..... 292/340; 292/200; 292/216; 292/231; 292/342; 49/394

(58) Field of Classification Search ..... 292/200, 292/340, 281, 8, 216, 342, 230, 231, 283, 292/341.11, 341.12, 341.13, 341.18, DIG. 39, 292/DIG. 46, DIG. 51, DIG. 55, 238; 49/394
See application file for complete search history.

(56) References Cited

U.S. PATENT DOCUMENTS 417,845 A * 12/1889 Stone ..... 292/341.13
1,690,408 A * 11/1928 Hasenflue ..... 292/340

(Continued)

FOREIGN PATENT DOCUMENTS

DE 2725345 A1 12/1978
EP 0 314 075 * 5/1989

(Continued)

OTHER PUBLICATIONS

Japanese Office Action issued Oct. 19, 2011 in Japanese application JP2007-280255, which is the Japanese application corresponding to the instant U.S. Appl. No. 12/374,952. This Japanese Office Action cites S55-6920.

(Continued)

*Primary Examiner* — Thomas A. Beach
*Assistant Examiner* — Nathan Cumar
(74) *Attorney, Agent, or Firm* — McDermott Will & Emery LLP

(57) ABSTRACT

A door panel of a side door of a machine has a latching mechanism, and a frame of the machine includes a striker. The striker includes a pair of vertically arranged mounting base portions, a pair of slanted shimmy-stopping surface portions formed on the mounting base portions so as to protrude in a V-like shape towards the latching mechanism, and a metal hooking portion protruding from a flat end portion that is provided between the slanted shimmy-stopping surface portions. The latching mechanism includes a mechanism body portion including main body plates. A U-shaped latch groove portion for engaging the metal hooking portion of the striker is formed by cutting away a part of each main body plate, and shimmy suppressing portions that are vertically arranged in a V-like shape are provided at the open end of each latch groove portion.

2 Claims, 9 Drawing Sheets

U.S. PATENT DOCUMENTS

| | | | | | |
|---|---|---|---|---|---|
| 1,888,829 | A | * | 11/1932 | Moore | 16/85 |
| 1,903,365 | A | * | 4/1933 | Haskins et al. | 16/86 B |
| 1,948,640 | A | * | 2/1934 | Andrews | 16/86 B |
| 3,433,518 | A | * | 3/1969 | Foltz | 292/238 |
| 3,549,185 | A | | 12/1970 | Lynn | |
| 3,734,551 | A | * | 5/1973 | Hughes et al. | 292/17 |
| 4,165,112 | A | * | 8/1979 | Kleefeldt | 292/216 |
| 4,305,611 | A | * | 12/1981 | Robins | 292/238 |
| 4,466,645 | A | * | 8/1984 | Kobayashi | 292/341.12 |
| 4,896,906 | A | * | 1/1990 | Weinerman et al. | 292/48 |
| 4,941,696 | A | * | 7/1990 | Yamada et al. | 292/340 |
| 5,069,491 | A | * | 12/1991 | Weinerman et al. | 292/48 |
| 5,125,698 | A | * | 6/1992 | Thau | 292/216 |
| 5,295,720 | A | * | 3/1994 | Budde | 292/201 |
| 5,358,292 | A | * | 10/1994 | Van Wiebe et al. | 292/235 |
| 5,529,356 | A | * | 6/1996 | Cetnar | 292/340 |
| 5,618,066 | A | | 4/1997 | Fu-Hsiang et al. | |
| 5,655,801 | A | * | 8/1997 | Casey | 292/210 |
| 5,707,092 | A | * | 1/1998 | Van Slembrouck et al. | 292/341.19 |
| 6,042,160 | A | * | 3/2000 | Hamada et al. | 292/216 |
| 6,347,819 | B1 | * | 2/2002 | Plaxco | 292/336 |
| 6,364,380 | B2 | * | 4/2002 | Franz | 292/219 |
| 6,685,241 | B2 | * | 2/2004 | Bollmann | 292/341.16 |
| 6,932,192 | B2 | * | 8/2005 | Blythe et al. | 182/82 |
| 7,025,395 | B2 | * | 4/2006 | Fisher | 292/340 |
| 7,029,043 | B2 | * | 4/2006 | Fisher | 292/341.13 |
| 7,344,169 | B2 | * | 3/2008 | Han | 292/340 |
| 7,909,372 | B2 | * | 3/2011 | Yamada | 292/340 |
| 7,938,458 | B1 | * | 5/2011 | Zweibohmer et al. | 292/197 |
| 2002/0000727 | A1 | * | 1/2002 | Rass et al. | 292/216 |
| 2002/0047280 | A1 | * | 4/2002 | Burton | 292/340 |
| 2003/0205904 | A1 | * | 11/2003 | Paskonis | 292/340 |
| 2004/0119299 | A1 | * | 6/2004 | Paskonis | 292/340 |
| 2007/0001468 | A1 | * | 1/2007 | Burton | 292/340 |
| 2007/0241570 | A1 | * | 10/2007 | Paskonis | 292/340 |
| 2010/0117379 | A1 | * | 5/2010 | Mitchell et al. | 292/216 |

FOREIGN PATENT DOCUMENTS

| | | |
|---|---|---|
| JP | S52-63817 | 5/1977 |
| JP | S55-6920 | 2/1980 |
| JP | 7293105 | 11/1995 |
| JP | 10102863 | 4/1998 |
| JP | 2001262618 | 9/2001 |
| JP | 2007137183 | 6/2007 |
| JP | 2007170114 | 7/2007 |

OTHER PUBLICATIONS

Chinese Office Action issued Dec. 23, 2011 in the Chinese application CN2008 8000 0332.2, which is the Chinese application corresponding to the instant U.S. Appl. No. 12/374,952. This Chinese Office Action cites U.S. Patent 3,549,185.

European Office Action issued in European Patent Application No. 08777881.7 mailed Oct. 5, 2012.

* cited by examiner

DOOR UNIT

CROSS REFERENCE TO RELATED APPLICATIONS

This is a U.S. national phase application under 35 U.S.C. §371 of International Patent Application No. PCT/JP2008/062166, filed Jul. 4, 2008, and claims the benefit of Japanese Application No. 2007-280255, filed Oct. 29, 2007. The International Application has not been published at the time of this filing. The contents of which are incorporated herein in their entirety.

TECHNICAL FIELD

The present invention relates to a door unit having a door panel that is provided with a latching mechanism.

BACKGROUND

FIG. 12 illustrates a hydraulic excavator 10, which is a work machine. The hydraulic excavator 10 includes a lower structure 11, an upper structure 12, a cab 13, a work equipment 14, and a power system 15 that includes an engine. The cab 13, the work equipment 14, and the power system 15 are mounted on the upper structure 12, which is rotatably mounted on the lower structure 11. The power system 15 is covered by a top cover 16, side doors 17, and other such components. For installation of these cover and side doors and other components, a frame is provided at the machine body. The top cover 16 and the side doors 17 are attached to the frame by hinges so as to be capable of opening and closing. Normally, the side doors 17 or other such components are secured in the closed state to the frame provided at the machine body by means of a latching device 18 (e.g. See Japanese Laid-open Patent Publication No. 2001-262618 (pages 3 to 4, and FIGS. 2 to 4) ("JP '610")), Japanese Laid-open Patent Publication No. 2007-137183 (page 3, and FIGS. 3 to 5) and Japanese Laid-open Patent Publication No. 2007-170114 (pages 5 to 8, and FIGS. 2 to 7) ("JP '114")).

As illustrated in FIG. 12, separate from the latching device 18, a shimmy stopping member 19 for preventing vertical vibration is attached to each side door 17. As illustrated in FIG. 13, the shimmy stopping members 19 serve to prevent vertical vibration of the side door 17 by respectively catching vertical vibration suppressors 19*a*, which are attached to the frame at the machine body.

Examples of conventional means to prevent such vertical vibration include a device for simultaneously stabilizing a portion where two doors overlap each other (e.g. See JP '618) and another device for fitting stoppers provided at the doors with stopper receivers that are provided at the frame at the machine body (e.g. See JP '114).

SUMMARY OF THE INVENTION

Providing shimmy stopping members 19 for preventing vertical vibration as separate members from the latching device 18 presents problems resulting from an increased number of parts, such as not being cost effective due to costs of parts.

Furthermore, should the work machine be a large machine that produces significant vibration, a plurality of shimmy stopping members 19 are required. Should this be the case, there may be limitations concerning the layout of the components.

In order to solve the above problems, an object of the invention is to reduce the number of parts and also facilitate the layout of the components by integrating with a latching device a shimmy stopping member for preventing vibration of a door panel.

The present invention relates to a door unit including a door panel attached to a frame so as to be capable of closing towards and opening away from the frame, an engaging member provided on the frame so as to protrude therefrom, the engaging member provided at such a location as to correspond to a distal end of the door panel, and a latching mechanism portion that is provided on the door and is capable of removably engaging the engaging member to suppress movement of the door panel in a direction in which the door panel is opened or closed, wherein the engaging member and the latching mechanism portion are integrally provided with a first shimmy-stopping engaging portion and a second shimmy-stopping engaging portion that are capable of engaging each other to suppress movement of the door panel in a direction intersecting a direction in which the door panel is opened or closed.

According to the present invention, the engaging member of the door unit includes a mounting base portion adapted to be fixed to the frame, a plurality of slanted shimmy-stopping surface portions that are formed on the mounting base portion so as to protrude therefrom towards the latching mechanism and collectively serve as the first shimmy-stopping engaging portion, and a stopper portion that protrudes from between the slanted shimmy-stopping surface portions and adapted to be inserted into the latching mechanism. Furthermore, the latching mechanism includes a mechanism body portion having a latch groove portion that is formed by cutting away a part of the mechanism body portion and is adapted to engage the stopper portion of the engaging member, and a plurality of shimmy suppressing portions that collectively serve as the second shimmy-stopping engaging portion and are integrally formed at the open end of the latch groove portion of the mechanism body portion and adapted to come into close contact with the plurality of shimmy stopping surface portions of the engaging member so as to prevent vibration of the mechanism body portion.

Further the first shimmy-stopping engaging portion and the second shimmy-stopping engaging portion of the door unit of the present invention are both positioned so as to prevent vertical vibration.

The latching mechanism of the door unit according to of the present invention is characterized by the latch groove portion of the mechanism body portion having a U-like shape formed by cutting away a part of the mechanism body portion and the shimmy suppressing portions being located at the open end of the latch groove portion so as to collectively form a V-like shape.

The engaging member of the frame and the latching mechanism on the door panel are not only adapted to engage each other to suppress movement of the door panel in a direction in which the door panel is opened or closed but also integrally provided with a first shimmy-stopping engaging portion and a second shimmy-stopping engaging portion that are capable of suppressing movement of the door panel in a direction intersecting a direction in which the door panel is opened or closed. This configuration provides a latching device that serves to suppress movement of the door panel in a direction in which the door panel is opened or closed and is integrally provided with shimmy stopping members for preventing vibration of the door panel in the direction intersecting a direction in which the door panel is opened or closed, thereby reducing the number of parts and also facilitating the layout of the components.

The engaging member of the frame also has a plurality of slanted shimmy-stopping surface portions that are formed on the mounting base portion so as to protrude therefrom towards the latching mechanism, and a stopper portion protruding from between the slanted shimmy-stopping surface portions and adapted to be inserted into the latching mechanism. The latching mechanism provided on the door panel has a mechanism body portion having a latch groove portion that is formed by cutting away a part of the mechanism body portion and is adapted to engage the stopper portion of the engaging member, and a plurality of shimmy suppressing portions that collectively serve as the second shimmy-stopping engaging portion and are integrally formed at the open end of the latch groove portion of the mechanism body portion and adapted to come into close contact with the plurality of shimmy stopping surface portions of the engaging member so as to prevent vibration of the mechanism body portion. With the configuration as above, the shimmy stopping members for preventing vibration of the door panel can be compactly integrated with the latching device.

The first shimmy-stopping engaging portion and the second shimmy-stopping engaging portion, both of which are positioned so as to prevent vertical vibration, are capable of reliably preventing vertical vibration of the door panel.

Further the second shimmy-stopping engaging portion is formed in a V-like shape at the open end of the latch groove portion, which is formed in a U-like shape by cutting away a part of the mechanism body portion. Therefore, the guiding function of the second shimmy-stopping engaging portion provides for reliable insertion of the stopper portion of the engaging member into the latch groove portion of the mechanism body portion, and the V-shaped second shimmy-stopping engaging portion is capable of restraining the first shimmy-stopping engaging portion of the engaging member. As a result, vibration of the door panel can reliably be prevented

DETAILED DESCRIPTION OF THE INVENTION

Next, the present invention is explained in detail hereunder, referring to an embodiment thereof shown in FIGS. 1 to 11.

Figure 11:
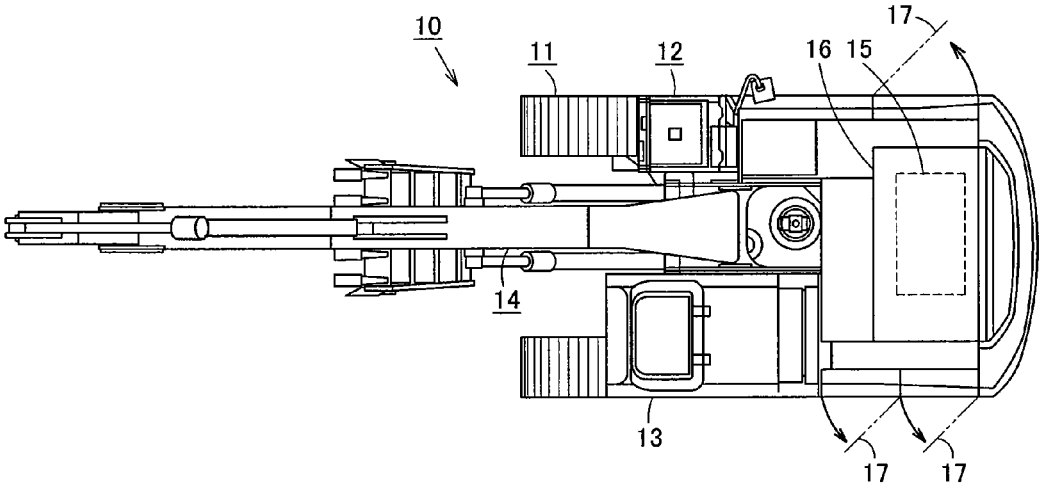
FIG. 11 is a plan view of a work machine provided with a door unit according to the present invention.
Figure 12:
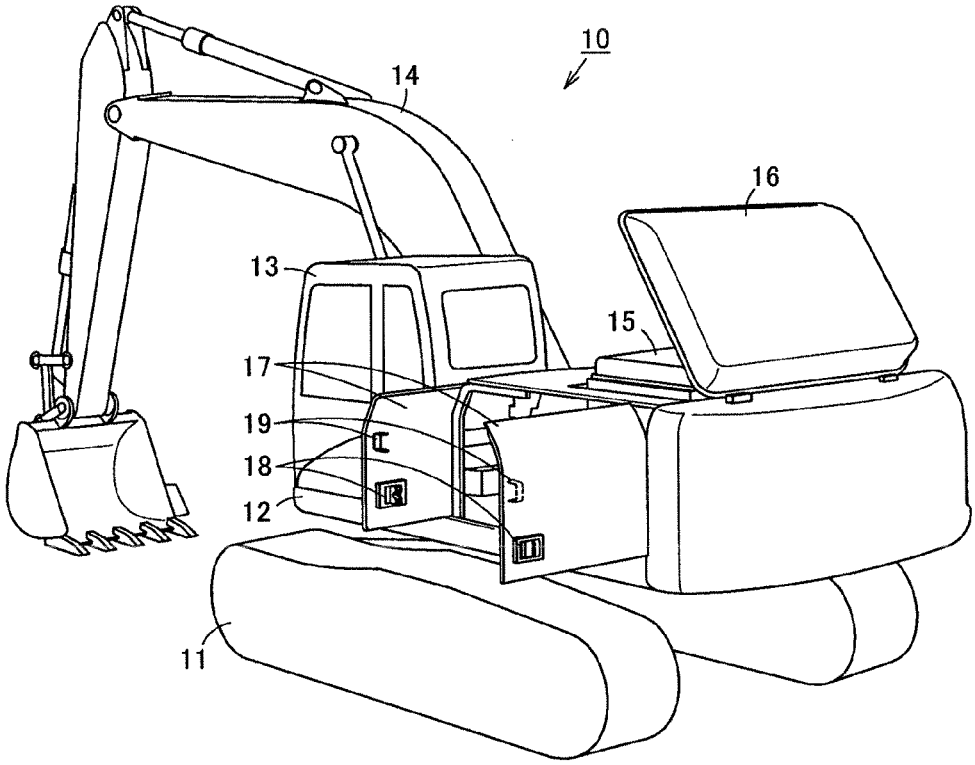
FIG. 12 Prior Art
FIG. 12 is a perspective view of a work machine provided with a conventional door unit.
Figure 13:
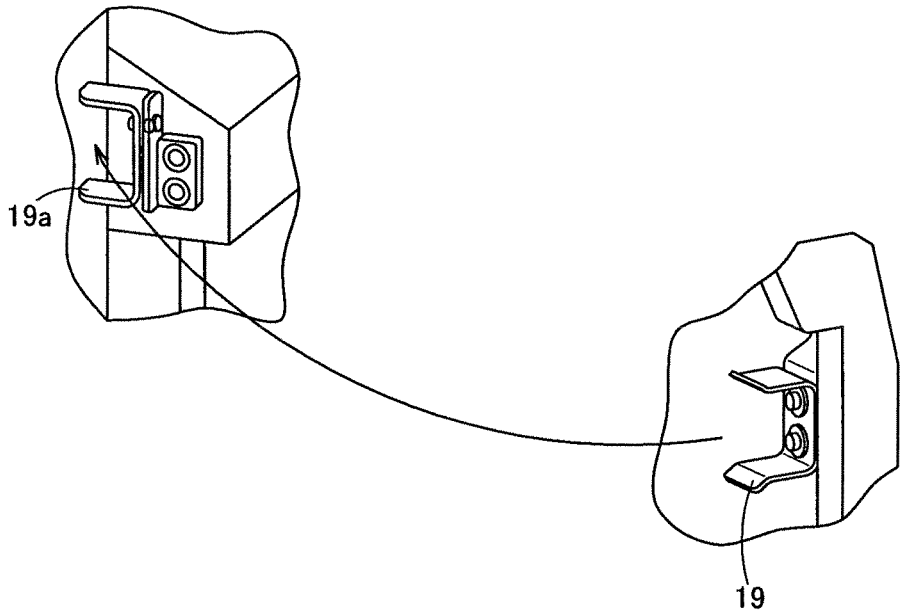
FIG. 13 Prior Art
FIG. 13 is a perspective view of a vertical vibration suppressing means of a conventional door unit.

FIG. 11 illustrates a hydraulic excavator 10, which is a work machine. The hydraulic excavator 10 includes a lower structure 11, an upper structure 12, a cab 13, a work equipment 14, and a power system 15 that includes an engine. The cab 13, the work equipment 14, and the power system 15 are mounted on the upper structure 12, which is rotatably mounted on the lower structure 11. The power system 15 is covered by a top cover 16, side doors 17, and other such components.

Figure 6:
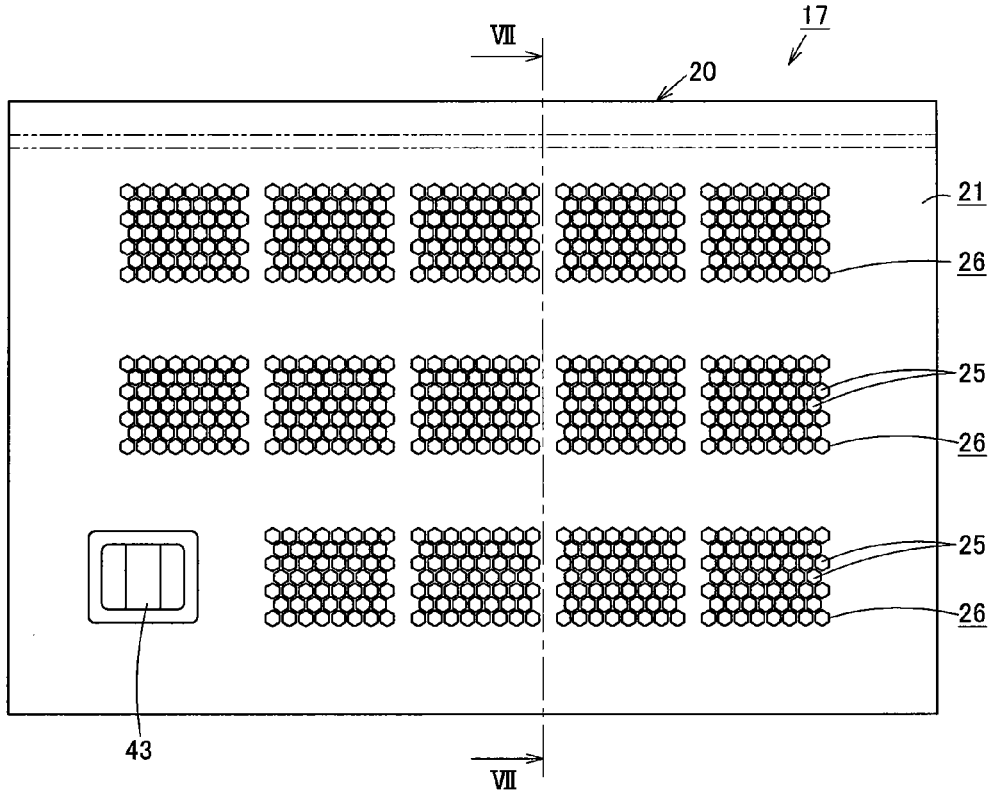
FIG. 6 is an external view of a door panel to which the latching mechanism of the latching device is attached.
Figure 7:
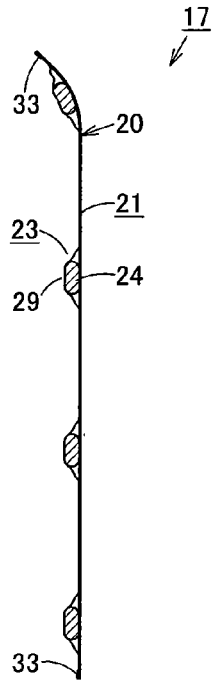
FIG. 7 is a sectional view taken along the line VII-VII of FIG. 6.
Figure 8:
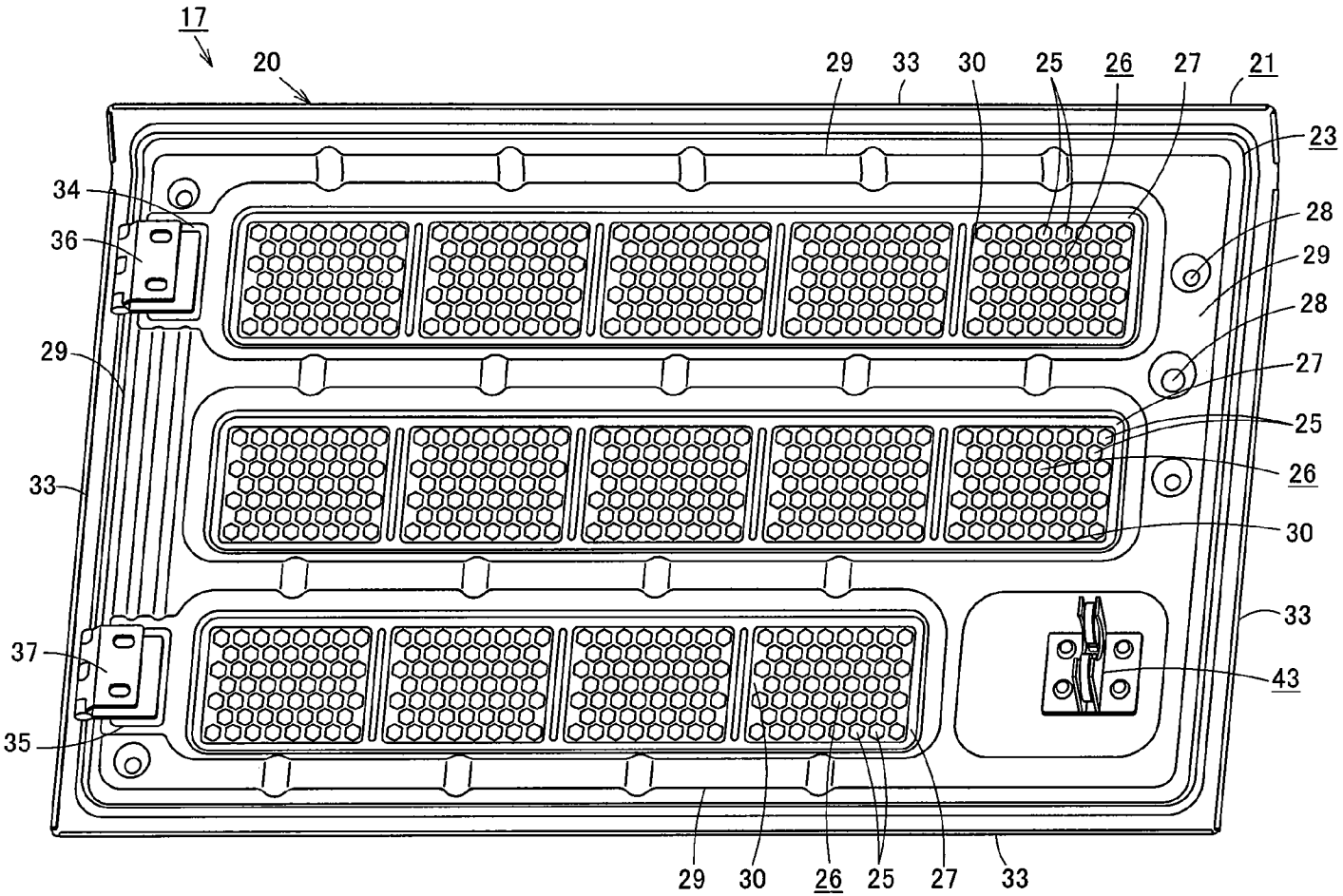
FIG. 8 is a perspective view of the inner side of the door panel to which the latching mechanism of the latching device is attached.

FIGS. 6 to 8 illustrate a door panel 20 of a side door 17. The door panel 20 includes an outer panel 21, an inner panel 23, and a foamed material 24. The inner panel 23 is formed by press molding a metal plate that is thinner than the outer panel 21 so as to have a bumpy surface with recessed portions and protruding portions. The recessed portions are fixed to the inner surface of the outer panel 21, and a space is formed between the protruding portions and the inner surface of the outer panel 21 and filled by the aforementioned foamed material 24.

As illustrated in FIG. 6, the outer panel 21 has a plurality of honeycomb ventilation hole sections 26, each of which comprises a plurality of regular hexagonal ventilation holes 25 that are formed through the material of the outer panel 21 so as to be arranged in a honeycomb pattern.

As illustrated in FIG. 8, the inner panel 23 has adhered portions 27,28, which are the aforementioned recessed portions adhered to the inner surface of the outer panel 21, and protruding portions 29 raised from the adhered portions 27,28.

The adhered portions 27 of the inner panel 23 are formed in three laterally extending rows at locations respectively corresponding to the rows of the honeycomb ventilation hole sections 26 of the outer panel 21. Each adhered portion 27 is provided with ventilation openings 30, each of which is larger than each honeycomb ventilation hole section 26 of the outer panel 21.

To be more specific, a plurality of ventilation openings 30 are formed in the adhered portions 27, which serve as a part of the recessed portions of the inner panel 23. Each ventilation opening 30 corresponds to and is slightly larger than each respective honeycomb ventilation hole section 26 of the outer panel 21.

The rim of the outer panel 21 has a hemmed portion 33 formed by hemming, in other words folding the rim of the outer panel 21 so as to curl over the rim of the inner panel 23 and then pressing down the folded part substantially flat.

At least the rim of the inner panel 23 is bonded to the outer panel 21 with an adhesive, which bonds as well as seals the outer panel 21 and the inner panel 23 together. The adhesive may desirably be a paste-type structural adhesive having both viscous and thermosetting properties.

An internal reinforcing plate (not illustrated) is disposed near one of the lateral ends of the inner side of the internal panel 23, i.e. the side facing the outer panel 21, and bonded to the outer panel 21. Through hinge mounting openings 34,35 formed in the inner panel 23, hinges 36,37 are welded or otherwise attached to the internal reinforcing plate.

Figure 5:
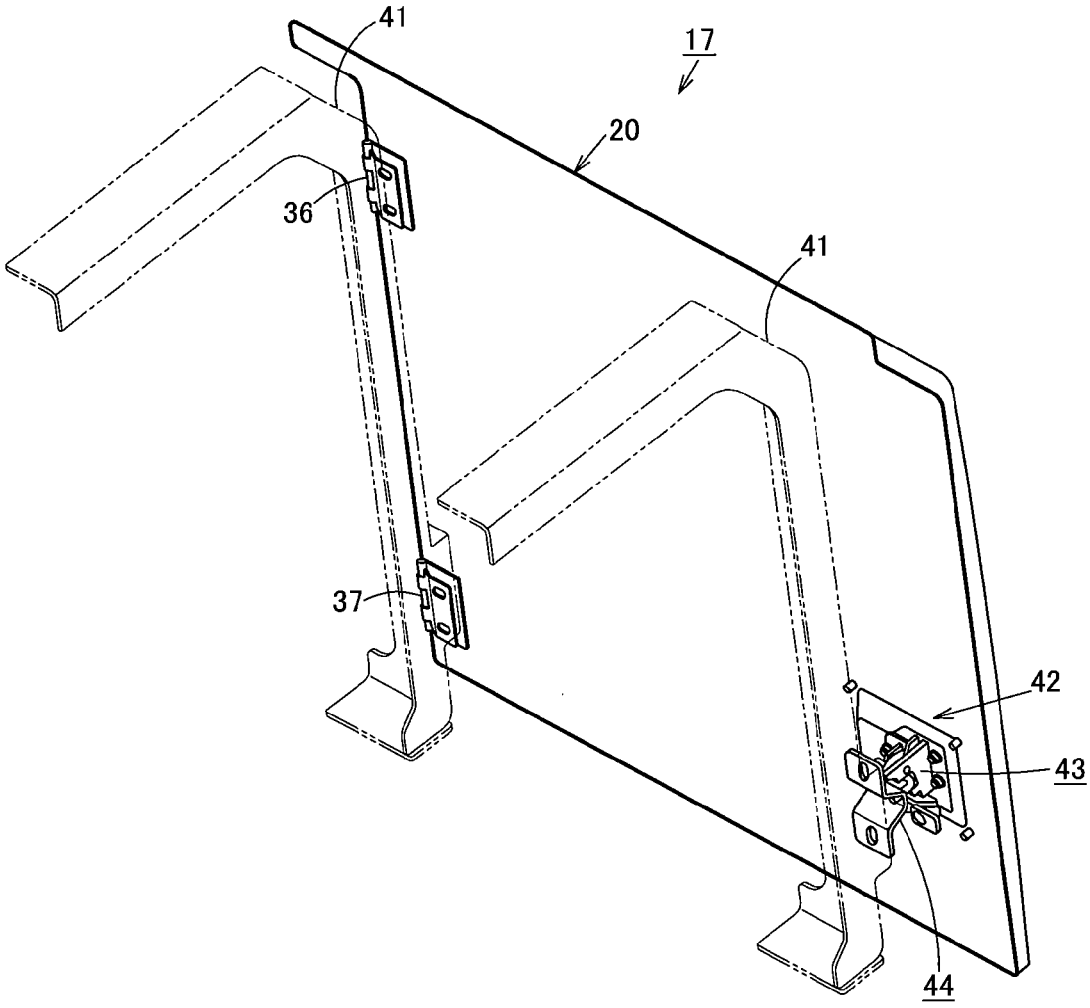
FIG. 5 is a perspective view of the latching device in an attached state.

As illustrated in FIG. 5, one of the lateral ends of the door panel 20 of the side door 17 is attached to a frame 41 at the machine body of the hydraulic excavator by means of the hinges 36,37 mentioned above to enable the door panel 20 to open and close freely. A latching mechanism 43 of a latching device 42 is provided at the other end of the door panel 20, i.e. the end opposite the end at which the hinges 36,37 are provided. A striker 44 that serves as an engaging member for engaging the latching device 42 protrudes from the frame 41 at the machine body so that the door panel 20 when being closed comes into contact with the striker 44. The latching mechanism 43 provided on the door panel 20 is capable of engaging with and disengaging from the striker 44.

Figure 1:
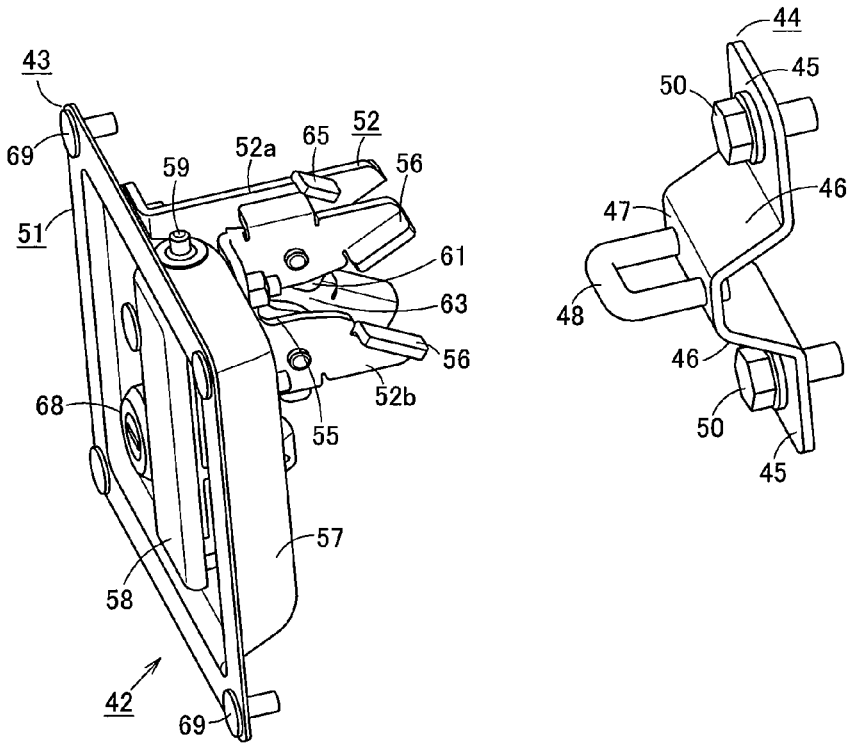
FIG. 1 is a perspective view of a latching device of a door unit according to an embodiment of the present invention.
Figure 2:
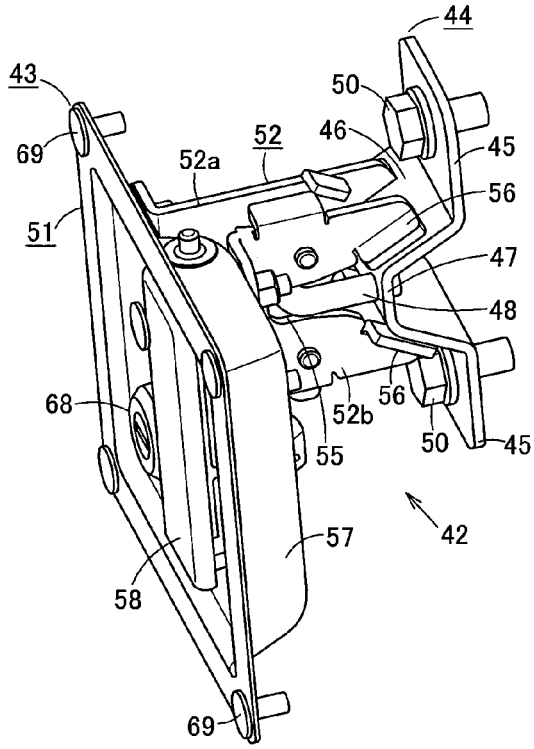
FIG. 2 is a perspective view of the aforementioned latching device in an engaged state.

As illustrated in FIGS. 1 and 2, the striker 44 includes a pair of mounting base portions 45, a pair of slanted shimmy-stopping surface portions 46, and a metal hooking portion 48. The mounting base portions 45 constitute the upper part and the lower part of the striker 44 respectively and are adapted to be fixed to the frame 41 provided at the machine body. The slanted shimmy-stopping surface portions 46 extend from the mounting base portions 45 respectively so as to protrude in a V-like shape towards the latching mechanism 43 and collectively serve as a first shimmy-stopping engaging portion. The metal hooking portion 48 is formed in a U-like shape from a member having a circular cross section and protrudes from a flat end portion 47, which is the portion between the slanted shimmy-stopping surface portions 46. The metal hooking portion 48 is adapted to be inserted into the latching mechanism 43 and serves as a stopper portion.

Figure 4:
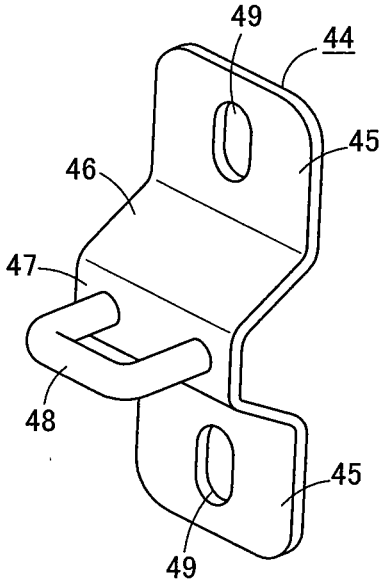
FIG. 4 is a perspective view of a striker serving as an engaging member of the latching device.

As illustrated in FIG. 4, an elongated hole 49 that is longer in the vertical direction is formed in each mounting base portion 45 of the striker 44. The striker 44 is attached to the frame 41 at the machine body with bolts 50 inserted in the elongated holes 49 as illustrated in FIG. 1. At that time, the vertical position of the striker 44 can be adjusted within the range of the elongated holes 49.

Figure 3:
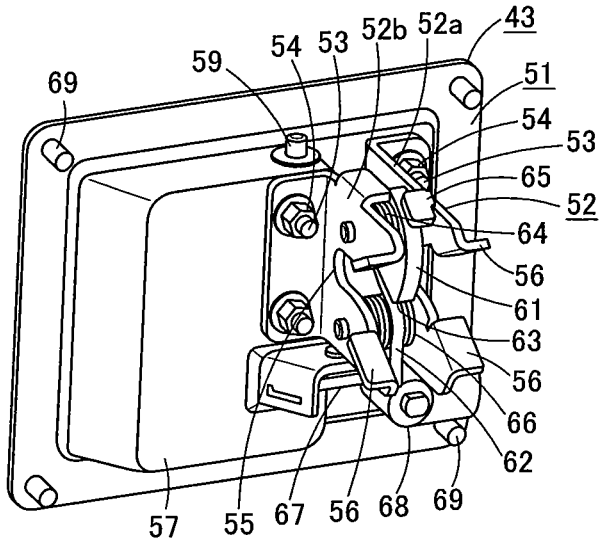
FIG. 3 is a perspective view of a latching mechanism of the latching device.

As illustrated in FIGS. 1 to 3, the latching mechanism 43 has a mounting plate 51 to be attached to the door panel 20. A pair of main body plates 52*a*,52*b*, which together constitute a mechanism body portion 52, are attached to the mounting plate 51 by means of bolts 53 and nuts 54. A portion of each main body plate 52*a*,52*b* of the mechanism body portion 52 is cut away to form a U-shaped latch groove portion 55 for engaging the metal hooking portion 48 of the striker 44. A pair of shimmy suppressing portions 56 that together form a V-like shape are provided at the open end of each latch groove portion 55 as an integral body therewith. These shimmy suppressing portions 56 collectively serve as a second shimmy-stopping engaging portion. Each shimmy suppressing portion 56 is formed by bending outward a part of each main body plate 52*a*,52*b* that is in the proximity of the open end of the latch groove portion 55.

The pair of slanted shimmy-stopping surface portions 46 of the striker 44 are vertically arranged as are the pair of shimmy suppressing portions 56 of each main body plate 52*a*,52*b* of the latching mechanism 43 so that the vertically arranged shimmy suppressing portions 56 come into close contact with the vertically arranged slanted shimmy-stopping surface portions 46 of the striker 44 and thereby prevent vertical vibration of the mechanism body portion 52.

As illustrated in FIG. 3, the mounting plate 51 is provided with an operation plate housing portion 57. As illustrated in FIG. 1, an operation plate 58 for disengagement is pivotally attached to the inside of the operation plate housing portion 57 by a shaft 59.

As illustrated in FIG. 3, the latching mechanism 43 has a latch plate 61 and a locking element 62, both of which are disposed between the pair of main body plates 52*a*,52*b* of the mechanism body portion 52. The latch plate 61 is disposed at a location close to one end of the pair of main body plates 52*a*,52*b* of the mechanism body portion 52 and pivotally supported by a shaft. The locking element 62 is disposed at a location close to the opposite end of the pair of main body plates 52*a*,52*b* and pivotally supported by a shaft.

The latch plate 61 has a receiving groove 63 for receiving the metal hooking portion 48 of the striker 44 therein when the metal hooking portion 48 is inserted into the latch groove portion 55 as illustrated in FIG. 2. The latch plate 61 is biased by a spring 64 to such an angle that the receiving groove 63 is open towards the opening of the latch groove portion 55 and stopped by a stopper 65. In response to insertion of the metal hooking portion 48, the latch plate 61 pivots and thereby closes off the receiving groove 63.

The locking element 62, which is constantly pushed against the rim of the latch plate 61 by a spring 66, latches onto the latch plate 61 at a locked state, in other words at an angle to close off the receiving groove 63. The locked state by the locking element 62 can be unlocked by a releasing element 67, which functions in conjunction with pivoting of the operation plate 58. The unlocking function of the releasing element 67 is kept in check by a locking device 68, which is provided adjacent thereto.

The mounting plate 51 of the latching mechanism 43 is attached to the door panel 20 by means of rivets 69.

Next, the operations and effects of the present embodiment are explained hereunder.

Figure 9:
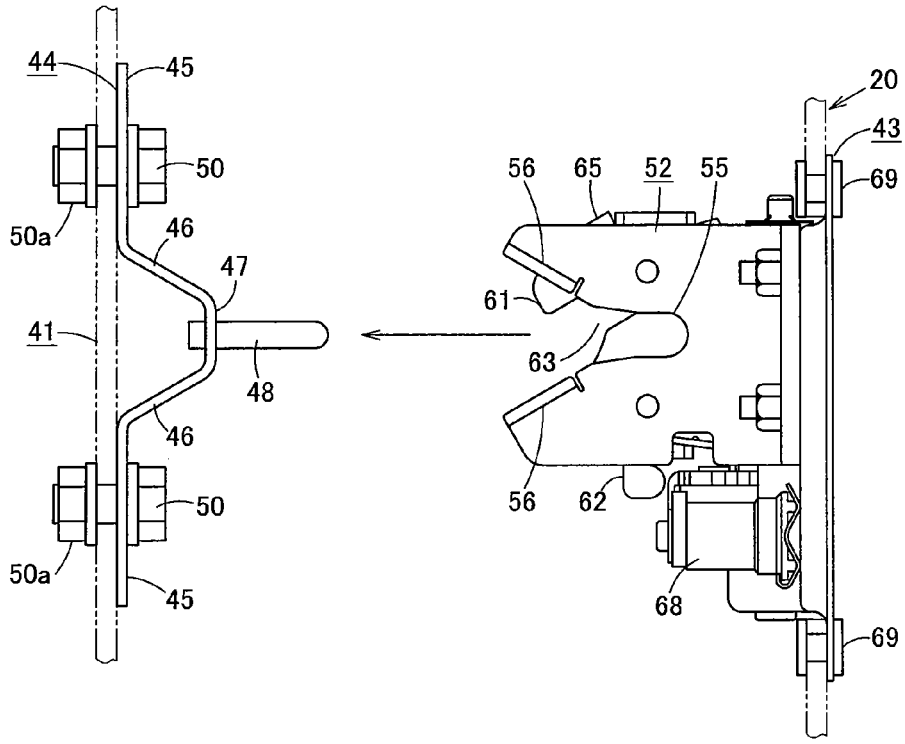
FIG. 9 is a side view of the latching device, illustrating the state before engagement.

As illustrated in FIG. 5, the door panel 20 of a side door 17, which is attached to one of the lateral ends of the frame 41 at the machine body by means of the hinges 36,37 so as to open and close freely. When the door panel 20 is closed, the latching mechanism 43 of the door panel 20 moves, as illustrated in FIG. 9, towards the striker 44 attached to the opposite end of the frame 41 with the bolts 50 and nuts 50*a* so that the metal hooking portion 48 of the striker 44 is inserted into the latch groove portion 55 of the mechanism body portion 52 as illustrated in FIG. 10.

Figure 10:
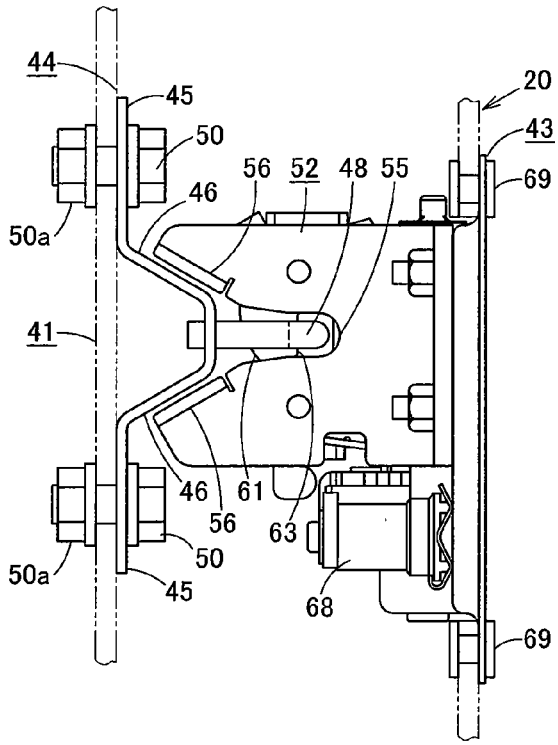
FIG. 10 is a side view of the latching device, illustrating the engaged state.

At that time, the receiving groove 63 of the latch plate 61 is pushed by the metal hooking portion 48 of the striker 44 so that, as illustrated in FIG. 10, the latch plate 61 pivots and securely engages the metal hooking portion 48 of the striker 44.

At that time, as the vertically arranged shimmy suppressing portions 56, which are formed as an integral body with the mechanism body portion 52 of the latching mechanism 43, fit to the vertically arranged slanted shimmy-stopping surface portions 46, which are formed as an integral body with the striker 44, vertical vibration of the door panel 20 of the side door 17 is prevented.

With the configuration as above, noise reduction is achieved by damping sound from the door panel 20 by means of the foamed material 24 filling the space between the inner panel 23, which can make the entire door panel 20 lighter because of its thinness as illustrated in FIG. 7, and the outer panel 21, which has a sufficient thickness to ensure the resistance to external impact. Furthermore, noise reduction is achieved also by preventing vibration sound from the door panel 20 by suppressing vertical vibration between the latching mechanism 43 and the striker 44 by means of fitting of the vertically arranged slanted shimmy-stopping surface portions 46 and the vertically arranged shimmy suppressing portions 56.

The striker 44 of the frame 41 provided at the machine body and the latching mechanism 43 provided on the door panel 20 engage each other to suppress movement of the door panel in a direction in which the door panel 20 is opened or closed. The striker 44 and the latching mechanism 43 are integrally provided with a plurality of slanted shimmy-stopping surface portions 46, which serve to suppress movement of the door panel 20 in a vertical direction, i.e. a direction intersecting a direction in which the door panel 20 is opened or closed, as well as a plurality of shimmy suppressing portions 56 to be fitted to the slanted shimmy-stopping surface portions 46. This configuration enables the latching device 42 for suppressing opening and closing of the door panel 20 to be integrally provided with shimmy stopping members that serve to prevent vibration of the door panel 20 in a direction intersecting a direction in which the door panel 20 is opened or closed, thereby reducing the number of parts and also facilitating the layout of the components.

A particular feature of the embodiment lies in that the striker 44 attached to the frame 41 provided at the machine body has a plurality of slanted shimmy-stopping surface portions 46 formed on the mounting base portions 45 so as to protrude therefrom towards the latching mechanism 43, and a metal hooking portion 48 protruding from between the slanted shimmy-stopping surface portions 46 and adapted to be inserted into the latching mechanism 43, and that the latching mechanism 43 provided at the door panel 20 has a mechanism body portion 52 having latch groove portions 55 that are formed therein by cutting away a part of the mechanism body portion 52 and are adapted to engage the metal hooking portion 48 of the striker 44, and a plurality of shimmy suppressing portions 56 that are integrally formed at the open ends of the latch groove portions 55 of the mechanism body portion 52 and adapted to come into close contact with the shimmy stopping surface portions 46 of the striker 44 and thereby preventing vibration of the mechanism body portion 52. With the configuration as above, the shimmy stopping members for preventing vibration of the door panel 20 can be compactly integrated with the latching device 42.

The vertically arranged plurality of slanted shimmy-stopping surface portions 46 and the vertically arranged plurality of shimmy suppressing portions 56 are capable of reliably preventing vertical vibration of the door panel 20.

The shimmy suppressing portions 56 are formed in a V-like shape at the open end of each latch groove portion 55, which is formed in a U-like shape by cutting away a part of the mechanism body portion 52. Therefore, the guiding function of the shimmy suppressing portions 56 provides for reliable insertion of the metal hooking portion 48 of the striker 44 into the latch groove portions 55 of the mechanism body portion 52, and the V-shaped shimmy suppressing portions 56 are capable of restraining the slanted shimmy-stopping surface portions 46 of the striker 44. As a result, vibration of the door panel 20 can reliably be prevented.

Although the slanted shimmy-stopping surface portions 46 of the striker 44 serve as the first shimmy-stopping engaging portion, and the shimmy suppressing portions 56 of the latching mechanism 43 serve as the second shimmy-stopping engaging portion according to the embodiments illustrated in the drawings, their positional relationship may be reversed. In other words, the first shimmy-stopping engaging portion may comprise the shimmy suppressing portions 56 of the latching mechanism 43, while the second shimmy-stopping engaging portion comprise the slanted shimmy-stopping surface portions 46 of the striker 44.

For example, the main body plates 52*a*,52*b* of the latching mechanism 43 and the mounting base portions 45 of the striker 44 may be processed so that the upper and lower portions of the main body plates 52*a*,52*b* are formed into a first shimmy-stopping engaging portion and that the upper end and the lower end of the mounting base portions 45 project towards the main body plates 52*a*,52*b* and serve as shimmy suppressing portions.

The present invention is applicable to a side door, a rear door, etc. of a work machine, such as a hydraulic excavator.

The invention claimed is:

1. A door unit for a hydraulic excavator comprising:

a door panel attached to a frame provided at a machine side of the hydraulic excavator to close towards and open away from the frame;

a striker provided on the frame so as to protrude therefrom, the striker provided at such a location as to correspond to a distal end of the door panel; and a latching mechanism that is provided on the door panel and has a latch plate which removably engages the striker;

wherein the striker comprises:

a pair of vertically arranged mounting base portions fixed to the frame by a bolt respectively;

a pair of vertically arranged slanted shimmy-stopping surface portions that are disposed on these mounting base portions towards the latching mechanism so as to form a V-shaped striker;

a flat end portion that is provided between ends of the vertically arranged slanted shimmy-stopping surface portions; and a metal hooking portion which is attached to the flat end portion and is adapted to be inserted into the latching mechanism; and wherein the latching mechanism comprises:

a mounting plate attached to a surface in the vertical direction of the door panel so as to face the striker;

a pair of main body plates attached to the mounting plate so to form vertical panels and parallel to each other to rotatably support the latch plate;

a latching groove portion having a U-shape, formed at the vertically arranged main body plates by cutting away so as to collectively form a V-shape from a side opposite the striker and adapted to engage the metal hooking portion of the striker; and a pair of vertically arranged shimmy-suppressing portions vertically arranged in a V-shape and formed by bending outward a part of each of the main body plates, provided at an open end of the latching groove portion, and fit the vertically arranged slanted shimmy-stopping surface portions of the striker;

wherein a receiving groove disposed at the latch plate to receive the metal hooking portion of the striker rotates in accordance with an inserting movement of the metal hooking portion from an angle at which the receiving groove is released to the open end of the U-shaped latching groove portion, and the latching groove portion is disposed at a place where the receiving groove is closed.

2. A door unit for a hydraulic excavator comprising:

a door panel attached to a frame at a machine side of the hydraulic excavator;

a striker protruding from the frame, the striker being positioned to correspond to a distal end of the door panel; and a latching mechanism provided on the door panel, the latching mechanism being configured to removably engage the striker;

wherein the striker comprises:

a mounting base portion fixed to the frame;

first and second slanted shimmy-stopping surface portions extending from the mounting base portion towards the latching mechanism so that the striker has a V-shape, the first slanted shimmy-stopping surface portion being arranged above the second slanted shimmy-stopping surface portion;

a flat end portion between ends of the slanted shimmy-stopping surface portions; and a metal hooking portion attached to the flat end portion and configured to be removably inserted into the latching mechanism; and wherein the latching mechanism comprises:

a mounting plate attached to the door panel to face the striker;

first and second main body plates attached to the mounting plate and arranged to be parallel to each other, each of the first and second main body plates having:

a U-shaped latching groove to receive the metal hooking portion of the striker; and first and second shimmy-suppressing portions provided across the U-shaped latching groove, the first shimmy-suppressing portion being arranged above the second shimmy-suppressing portion so that the first and second shimmy-suppressing portions are fit the first and second slanted shimmy stopping surface portions of the striker when the metal hooking portion of the striker is inserted into the U-shaped latching groove; and a latch plate rotatably supported between the parallel plates to rotate between a first position to hold the metal hooking portion inserted into each U-shaped latching groove and a second position to release the metal hooking portion, the latch plate having a latching groove to receive the hooking portion, the latch plate being configured to rotate from the first position to the second position when the metal hooking portion is being inserted into each U-shaped latching groove to receive the metal hooking portion in the latching groove, and rotate from the second position to the first position to hold the metal hooking portion when the metal hooking portion is inserted into the latching groove.

* * * * *